United States Patent [19]

Regone

[11] Patent Number: 4,793,274

[45] Date of Patent: Dec. 27, 1988

[54] METHOD AND APPARATUS FOR CONDUCTING GEOPHYSICAL EXPLORATION FROM A MARINE VESSEL

[75] Inventor: William R. Regone, La Place, La.

[73] Assignee: Amoco Corporation, Chicago, Ill.

[21] Appl. No.: 38,397

[22] Filed: Apr. 15, 1987

[51] Int. Cl.[4] ..... B63B 21/16

[52] U.S. Cl. ..... 114/242; 114/254

[58] Field of Search ..... 114/240 A, 240 B, 242, 114/244, 253, 254, 268, 255, 270; 367/15, 19, 20; 181/108, 110, 111, 112

[56] References Cited

U.S. PATENT DOCUMENTS

| | | | |
|---|---|---|---|
| 3,892,386 | 7/1975 | Hogan | 114/254 |
| 4,270,479 | 6/1981 | Baker et al. | 114/240 A |
| 4,349,180 | 9/1982 | Charles et al. | 114/254 |
| 4,406,242 | 9/1983 | Weeks | 114/242 |
| 4,480,574 | 11/1984 | Bertrams | 114/254 |
| 4,570,245 | 2/1986 | Thigpen | 114/244 |
| 4,597,352 | 7/1986 | Norminton | 114/254 |

*Primary Examiner*—Sherman D. Basinger
*Assistant Examiner*—Stephen P. Avila
*Attorney, Agent, or Firm*—Timothy D. Stanley

[57] ABSTRACT

Method and apparatus for conducting geophysical exploration from a marine vessel. A ship includes a pair of booms mounted on the stern thereof which are moveable between a stowed position adjacent the ship and an extended position athwartships. A plurality of winches are mounted on the ship. Each winch includes a cable wound thereon. Each cable is journaled over pulleys to a different airgun deployment station on the boom. Each airgun may be individually deployed in the water behind the boom under power of the winch associated therewith. Roller mechanisms mounted on the boom support a different firing line cable which is connected between equipment on the ship and each airgun.

21 Claims, 16 Drawing Sheets

METHOD AND APPARATUS FOR CONDUCTING GEOPHYSICAL EXPLORATION FROM A MARINE VESSEL

BACKGROUND OF THE INVENTION

The instant invention pertains to a method and apparatus for conducting geophysical exploration from a marine vessel and more particularly to such methods and apparatus in which geophysical exploration devices are deployed on cables from a boom mounted on a ship.

In marine seismic exploration, a ship tows at least one line which has one or more airguns suspended therefrom for generating a burst of seismic energy. Typically, the ship also tows a streamer cable which includes a plurality of hydrophones for detecting the earth's response to the burst of seismic energy. When an airgun is fired, seismic waves are generated which propagate through the water and into the formations beneath the water. Reflected and refracted seismic waves return from the underground formations and are detected by the hydrophones. The signals generated by the hydrophones are processed to determine the nature of the formations.

One configuration for conducting such exploration involves an array of airguns suspended on a plurality of cables which are deployed from the stern of a ship. Each cable includes several airguns which are disposed along the length thereof. In order to produce the widest possible areal array, paravanes, which include rudders for steering, are positioned at the outermost end of the outside cables in the areal array. The paravanes force the ends of the cables outwardly thus producing an areal array of airguns which is wider than when each of the airgun cables is deployed directly behind the ship from the stern thereof.

The above-described prior art technique for towing strings of airguns suffers from several disadvantages. First, if a single airgun on one of the cables should become inoperative, the entire cable must be pulled from the water to replace the inoperable airgun thereby removing several functioning guns from the array. Moreover, if the inoperable airgun is on one of the outside cables, one or more inside cables must first be removed from the water.

Another disadvantage relates to the surface area of each cable, including the airguns suspended therefrom. A long cable having several airguns suspended therefrom presents a large surface area which makes it difficult to tow the guns at lower depths. In other words, as the cable is towed, water acting against the surface area presented tends to force the cable and airguns toward the surface of the water. The faster the speed of the ship, the closer the airguns to the water surface.

Yet another disadvantage in the airgun areal arrays of the type described relates to the paravanes. In order to keep the paravanes the desired distance apart to produce an airgun areal array of a selected width, ship speed must be maintained above a minimum level. It is desirable to generate seismic energy bursts at preselected distances along the formation over which the ship moves. If the ship is traveling at too rapid a speed, reflected seismic waves from a preceding shot may not be completely recorded when it is time to generate another shot. Thus, in order to generate an accurate survey, the upper speed of the ship is limited. It may, in some instances, be desirable to utilize a wide airgun areal array in a survey which requires relatively frequent firing of the airguns. Such a survey may not be possible to conduct with the above-described prior art system due to the necessity to decrease speed in order to achieve the selected frequency of airgun firing and the necessity to increase speed in order to maintain the selected airgun areal array width.

The above-described prior art system for deploying an airgun array produces an areal array in which width of the array and depth of the airguns therein vary considerably dependent upon ship speed.

U.S. Pat. No. 4,480,574 to Bertrams discloses a ship with seismic gun jibs. In Bertrams, the ship includes a pair of booms which extend laterally therefrom at the stern. A plurality of winches are mounted on each boom at selected distances therealong and a single airgun is attached to the end of a cable wound onto each winch. A dolly which is moveable along the longitudinal axis of each boom therebeneath is provided to support an airgun being transported between the ship and one of the winches. In Bertrams, if one of the airguns becomes inoperable, the winch from which the inoperable airgun is deployed may be operated to retrieve the airgun which may be repaired or replaced without interfering with the other airguns in the array. Moreover, the Bertrams towing arrangement permits towing a areal array of airguns at a relatively slow speed without affecting the width of the airgun array. Bertrams also deploys a linear streamer from the stern of the ship which includes a plurality of hydrophones for recording the earth's response to the burst of seismic energy from the airgun array.

In addition to the cable which supports the weight of the airgun, a control line, such being generally referred to as a firing line, is connected at one end to the airgun and at the other end to equipment on board the ship. The firing line includes a high pressure hose for charging the airgun, a solenoid line for firing the gun, a depth transducer line, a gun phone line for measuring gun firing, and a stress line. In combination with a Bertrams-type boat and gun jib, it is known to extend a firing line from each air gun to a pulley mounted on the boom adjacent the winch from which the airgun associated therewith is deployed. The firing line is draped over the water between the pulley and the side of the ship from where the firing line is paid out and taken in by hand as the winch reels cable in and out.

The Bertrams arrangement does not overcome all of the problems presented by the prior art. The Bertrams air gun deployment scheme cannot create an areal array as wide as the above-described prior art technique in which paravanes are incorporated on the outer cables of the areal array. This limitation on the width of the Bertrams-type areal array is the result of the weight of the winches on the booms. A boom which is long enough to produce an areal array having a width equal to that of the prior art paravane array would not be able to support the weight of all the winches from which the individual airguns are deployed.

Bertrams provides a dolly arrangement for transporting an air gun between the ship and the boom. In order to retrieve the geophysical exploration device, i.e,, an airgun, it is necessary to pay off the cable on the winch under minimum pressure on the cable. The weight of the airgun is taken off the cable and transferred to the dolly. If the cable snags or not enough cable is payed out, the airgun can be pulled off the dolly. Moreover, a separate lifting device is necessary to move an airgun between the ship deck and the dolly.

There exists a need for a method and apparatus for deploying geophysical exploration devices from a marine vessel which overcome the above-described disadvantages inherent in the prior art. More specifically, there exists a need for such a method and apparatus in which a sufficiently wide airgun areal array may be towed at any selected speed without altering the width of the areal array and without substantially altering the depth of the individual airguns in the array. There exists a need for such a method and apparatus which incorporates improved means for handling airgun firing lines. There exists a need for such a method and apparatus in which each airgun may be safely and conveniently transported between a deployed position and the deck of the ship.

SUMMARY OF THE INVENTION

The present invention provides an apparatus for geophysical exploration including a ship having a boom mounted thereon. A winch mounted on the ship includes a cable having a first end wound thereon and a second end rigged through the pulley means mounted on the boom a selected distance from the ship. A geophysical exploration device is attached to the other end of the cable thus enabling deployment of the device from the boom under power of the winch.

In another aspect of the invention, shuttle means mounted on said boom is moveable along a path parallel to the boom axis for positioning a geophysical exploration device at a selected distance from the ship.

DETAILED DESCRIPTION OF THE PREFERRED EMBODIMENT OF THE INVENTION

Generally speaking, the apparatus of the instant invention comprises a ship having a pair of booms mounted thereon which are moveable between stowed and extended positions. Each boom includes a plurality of pulleys mounted at selected distances therealong. A winch corresponding to each pulley is mounted on the ship. A cable extends from each winch through the pulley associated therewith and a geophysical exploration device, such as an airgun, is attached to the end of each cable.

In operation, each airgun may be independently deployed from the boom or returned to the same by operating a selected winch. The booms may be moved between stowed and extended positions with the airguns suspended therebeneath above the surface of the water.

In another aspect of the invention, a shuttle is provided for moving a selected airgun between a position in which the airgun is suspended from the boom below its associated pulley and the deck of the ship.

In yet another aspect of the invention, a shuttle which is moveable along the boom is provided for deploying a cable having geophysical exploration device, such as a hydrophone, attached thereto.

Figure 1:
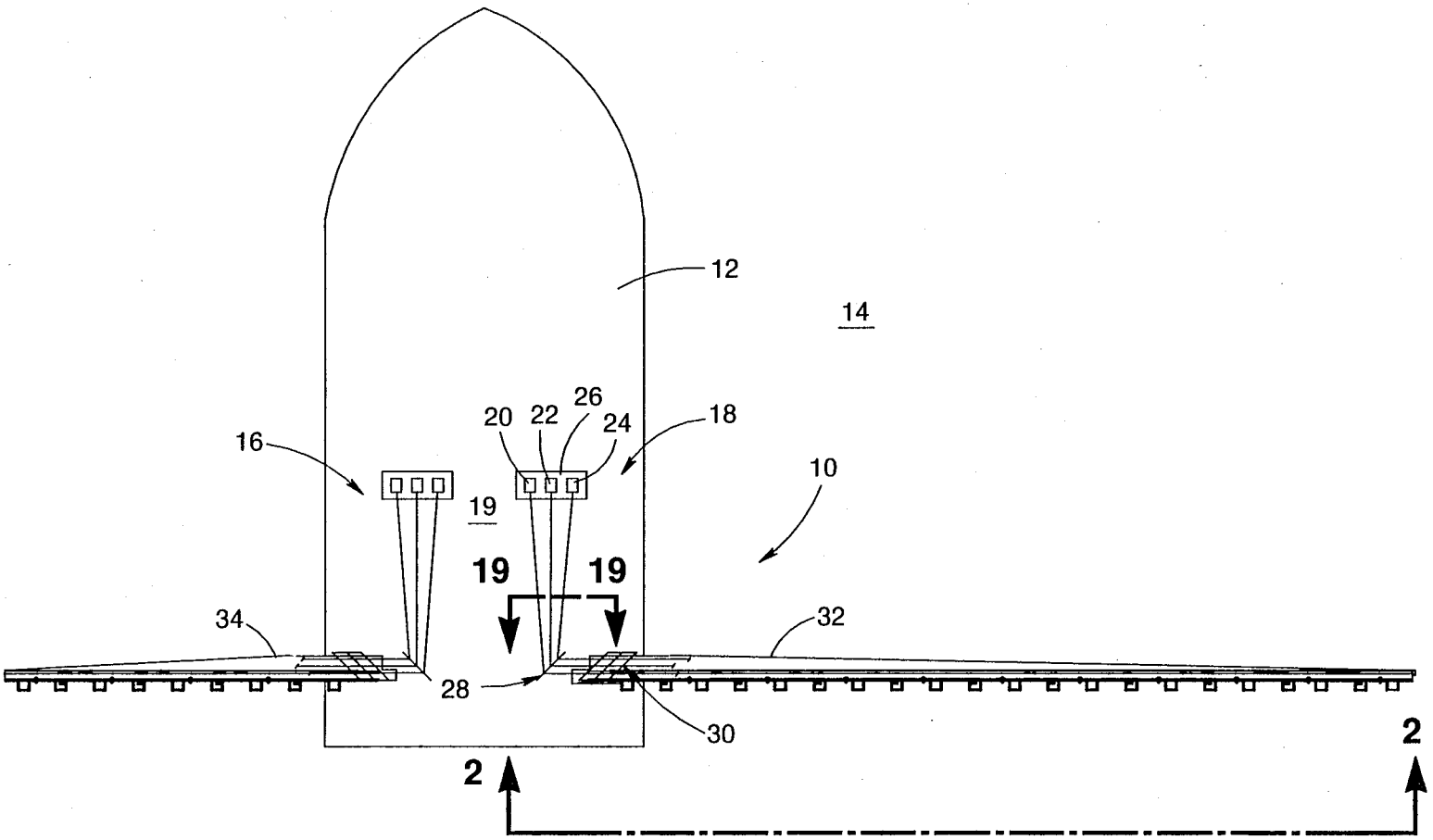
FIG. 1 is a top plan view of apparatus constructed in accordance with the instant invention including a pair of booms (with the port boom only partially shown) in an extended position.

Turning now to the drawings, indicated generally at 10 in FIG. 1 is an apparatus constructed in accordance with the instant invention. Included therein is a commercially available ship 12 floating on a body of water 14. Mounted on the ship is a port winch set 16 and a starboard winch set 18. Winches 20, 22, and 24 are included in starboard winch set 18. The winch sets are supported on a ship deck 99. Starboard winch set 18 includes a winch deck 26 upon which winches 20, 22, and 24 are mounted. Deck 26 is positioned approximately 10 feet above ship deck 19.

The starboard winch set 18 further includes a second group of four winches (not shown) mounted on winch deck 26 directly astern of winches 20, 22, and 24 and approximately 7 in. below them to avoid tangling their respective cables. These four winches are generally oriented in the same direction as winches 20, 22, and 24, i.e., cable is reeled in and out toward the stern of ship 12.

The starboard winch set 18 further includes a third group of four winches (not shown) mounted on winch deck 26 directly astern of the second group of winches and approximately 7 in. below them to avoid tangling their respective cables. The third group of winches is generally oriented in the same direction as the other winches. Thus, starboard winch set 18 includes a total of eleven winches generally oriented to reel cable out toward the stern of ship 12. For the sake of clarity, the second and third groups of winches and their associated cables are not shown in FIG. 1.

Port winch set 16 is substantially identical in structure and operation to starboard winch set 18. In the instant embodiment of the invention, winch sets 16 and 18 are approximately 30 feet from their respective booms. This distance is to ensure (at least in the instant embodiment) that the winches reel cable on and off in level winds.

A first guide frame 28 is shown in somewhat schematic form in FIG. 1 and is mounted on the ship in a manner which will be hereinafter more fully explained. Guide frame 28 provides a support for 11 pulleys (not visible in FIG. 1) over which cables from the winches in starboard winch set 18 are journaled. A more detailed view of guide frame 28 is contained in FIGS. 18 and 19.

A second guide frame 30 provides means for mounting 11 pulleys (not visible). The cables from starboard winch set 18 are journaled over the pulleys on guide frame 28 and over pulleys on guide frame 30 and from there extend along a starboard boom 32. A more detailed view of guide frame 30 is contained in FIGS. 11 and 12.

First and second guide frames are also provided on the port side of ship 12 which are substantially symmetrical, with respect to the longitudinal axis of the ship, with guide frames 28 and 30. Each of the port guide frames accommodate cables from port winch set 16 in the same fashion as guide frames 28 and 30. The cables from the port winch set 16 are directed by pulleys on the port guide frames along a port boom 34. In the instant embodiment of the invention, booms 32 and 34 are each 108 feet long with 8 feet onboard and 100 feet overboard when the booms are configured as in FIG. 1.

Figure 2:
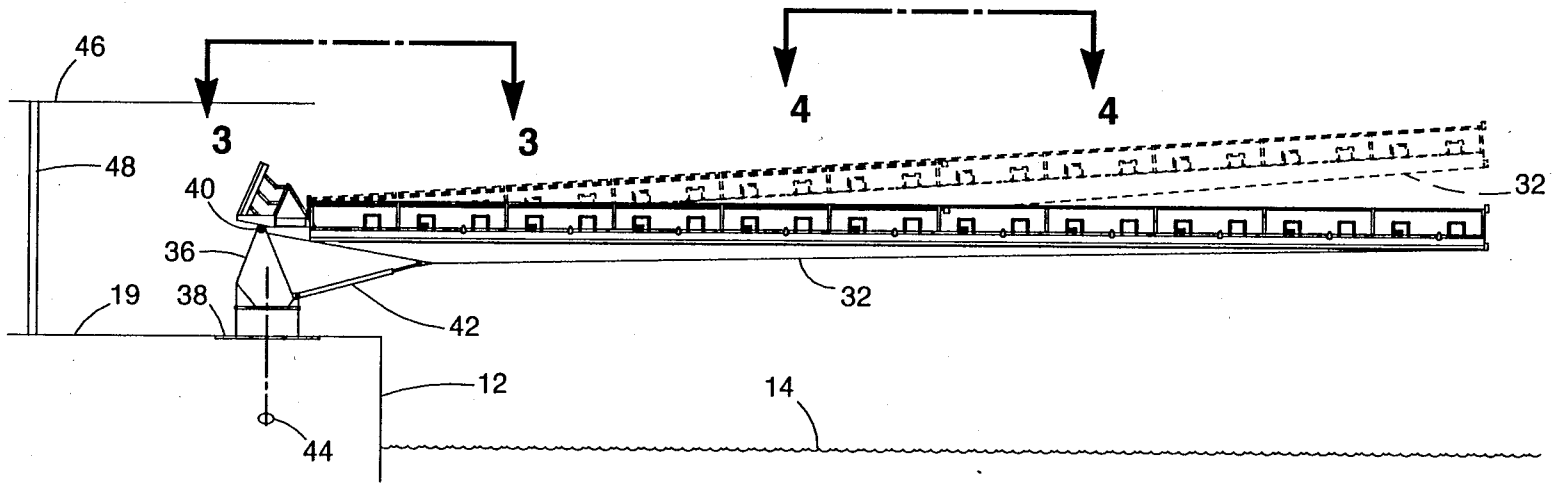
FIG. 2 is an enlarged view taken along line 2—2 in FIG. 1

In FIG. 2, boom 32 is shown in an unrigged condition and guide frame 28 is omitted to clarify certain ship and boom structure. The inboard end of boom 32 is mounted on a rotatable pedestal 36 which in turn is mounted on a base 38 supported on ship deck 19. Boom 32 is pivotally connected to pedestal 36 via connection 40. A plurality of rams, with only ram 42 being visible, are each pivotally connected at one end to boom 32 and at the other end to pedestal 36.

In operation, the rams, like ram 42, may be extended under hydraulic power to move the boom from a lowered position, shown in solid lines, to a raised position, shown in dashed lines. During such movement, the boom pivots about connection 40 which is referred to herein as pivot means.

Figure 16:
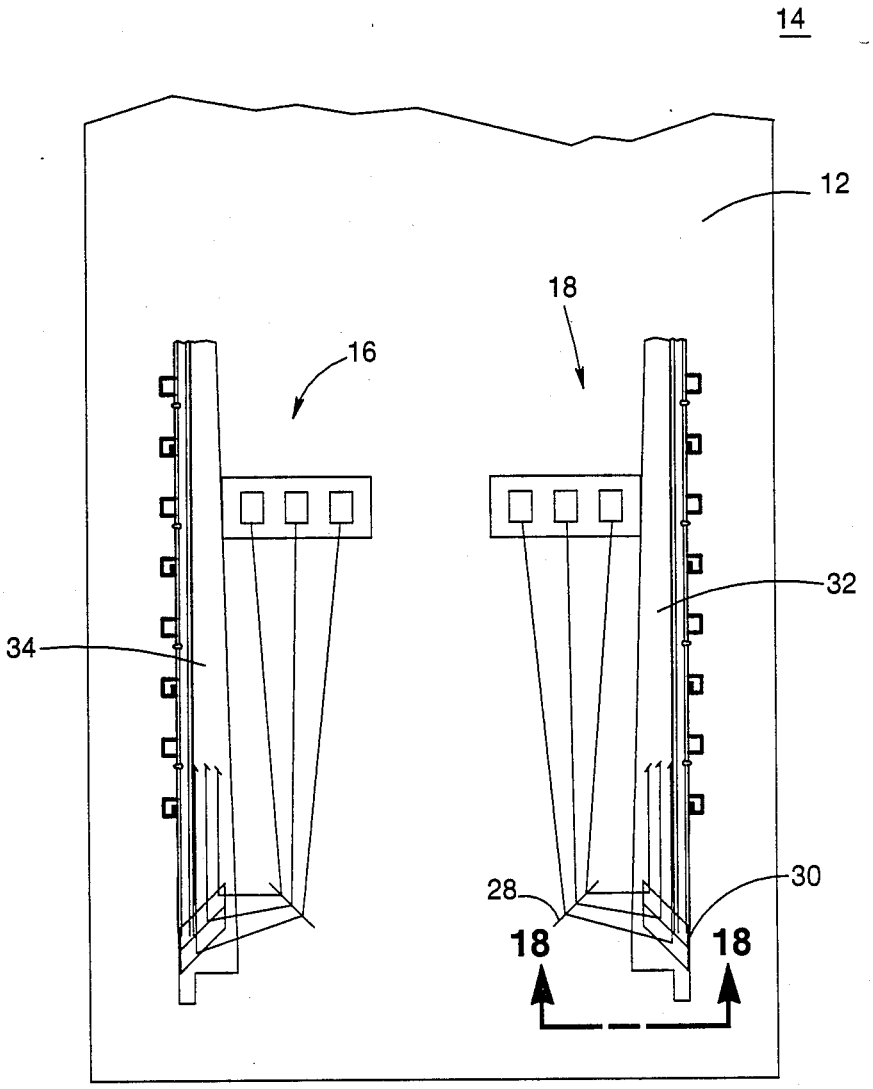
FIG. 16 is a top plan view similar to FIG. 1 but with the booms in a stowed condition.
Figure 17:
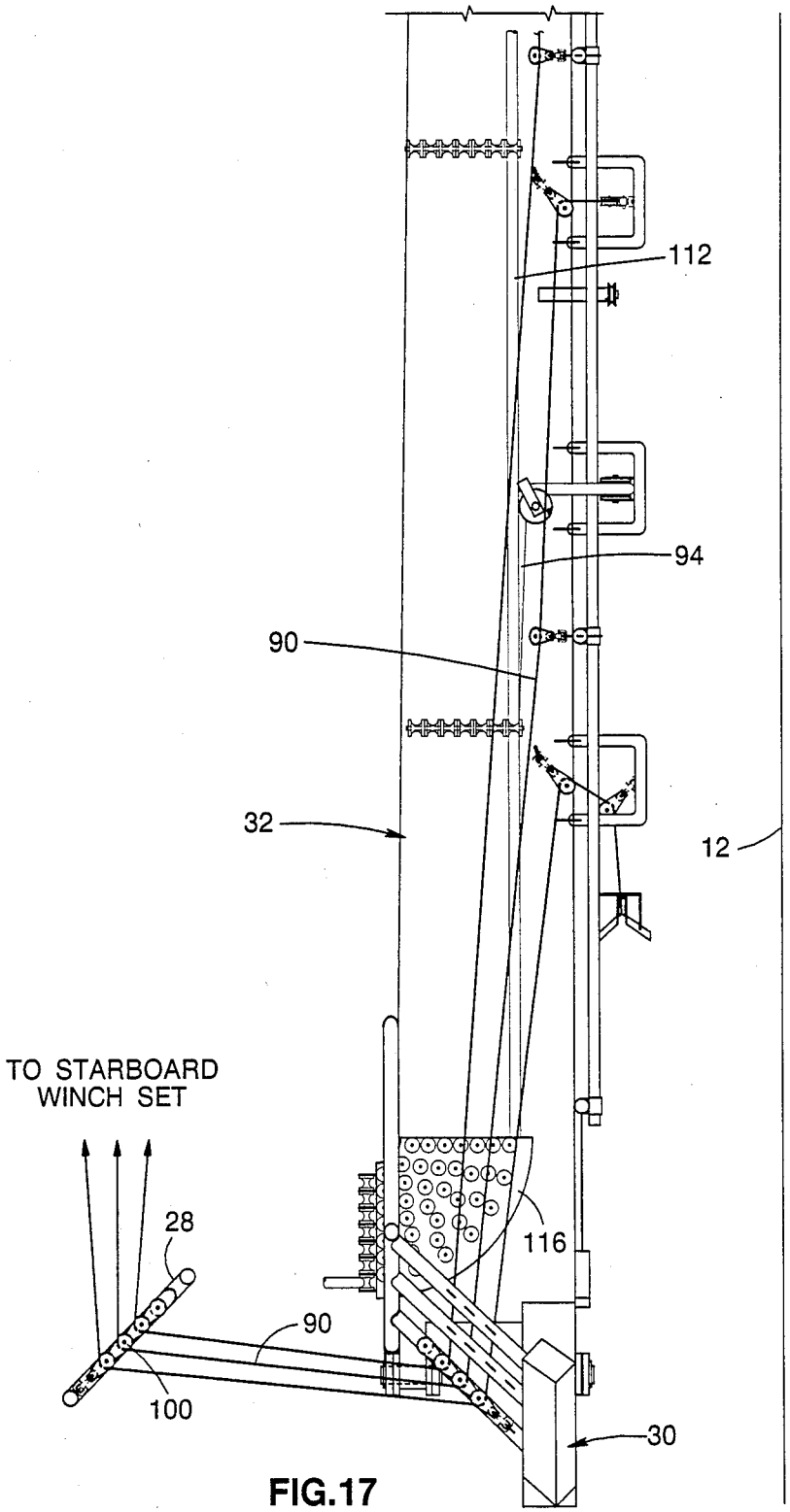
FIG. 17 is an enlarged view of a portion of FIG. 16.

When pedestal 36 is rotated, boom 32 may be moved between an extended position, as shown in FIGS. 1 and 2, and a stowed position, as shown in FIG. 16. Pedestal 36 rotates horizontally about axis 44.

Figure 18:
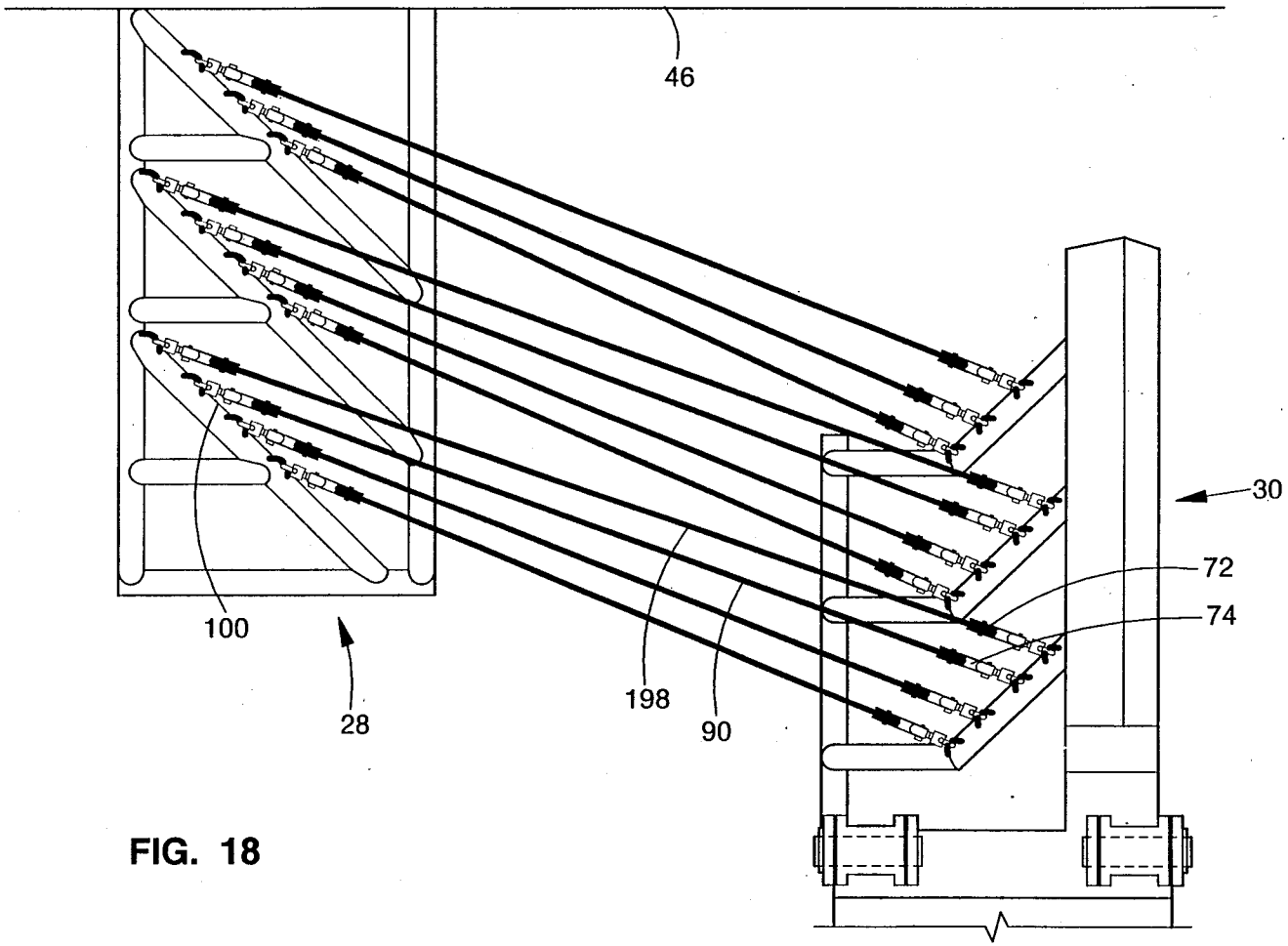
FIG. 18 is an enlarged view of the guide frames taken along line 18—18 in FIG. 16.
Figure 19:
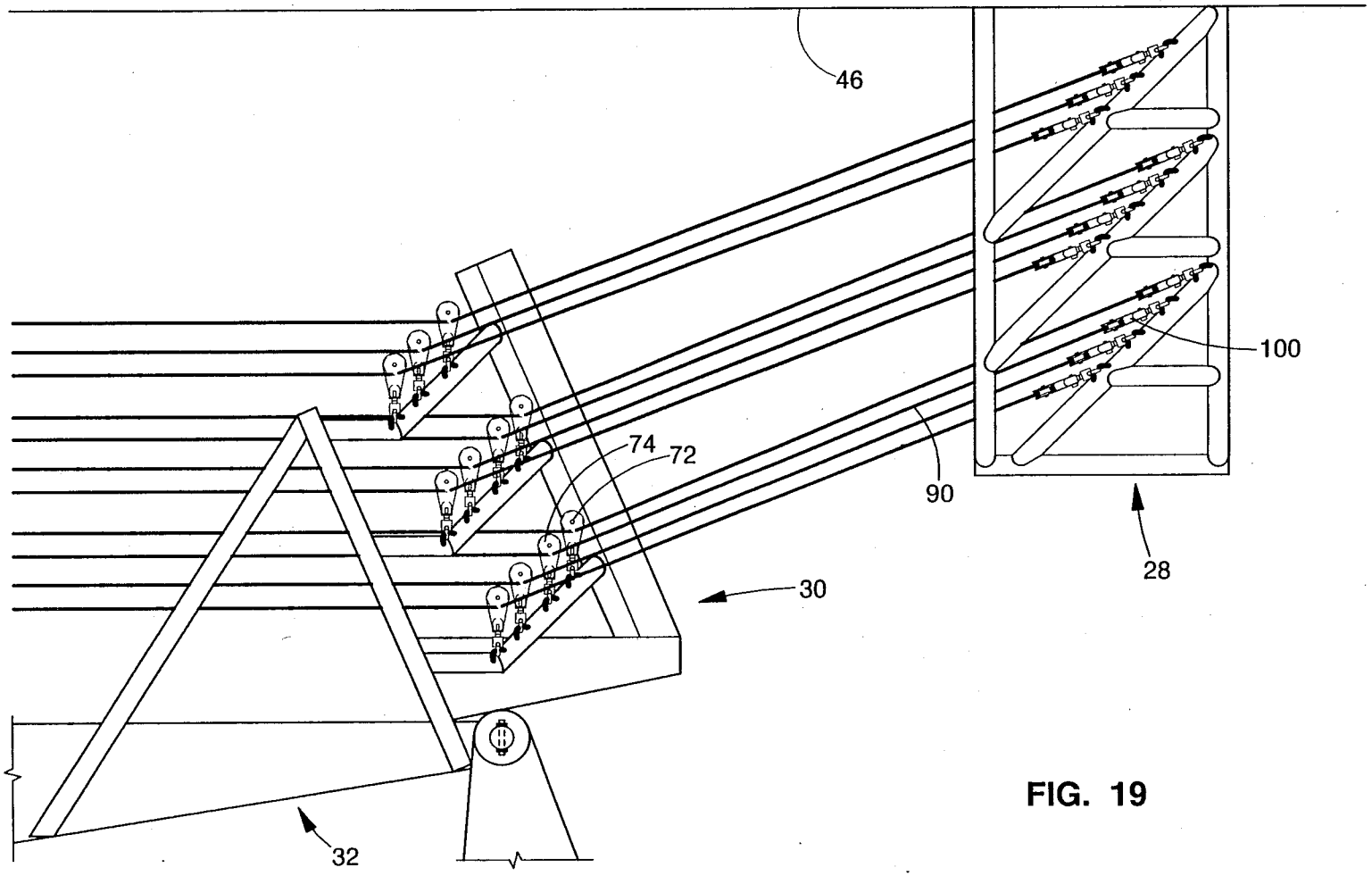
FIG. 19 is an enlarged view of the guide frames taken along line 19—19 in FIG. 1.

Ship 12 includes an upper ship deck 46 which is supported over deck 19 via posts, like post 48. As can be seen in FIGS. 18 and 19, guide frame 28 is mounted on the underside of deck 46. As will later be described in connection with the operation of the instant embodiment of the invention, it may be desirable to deploy geophysical devices from boom 32 in the dashed line position of FIG. 2. In order to move the booms to their stowed position, as shown in FIG. 16, it is necessary for both booms to be moved to the lowered position, as shown in solid lines in FIG. 2, in order to be received under deck 46.

Figure 3:
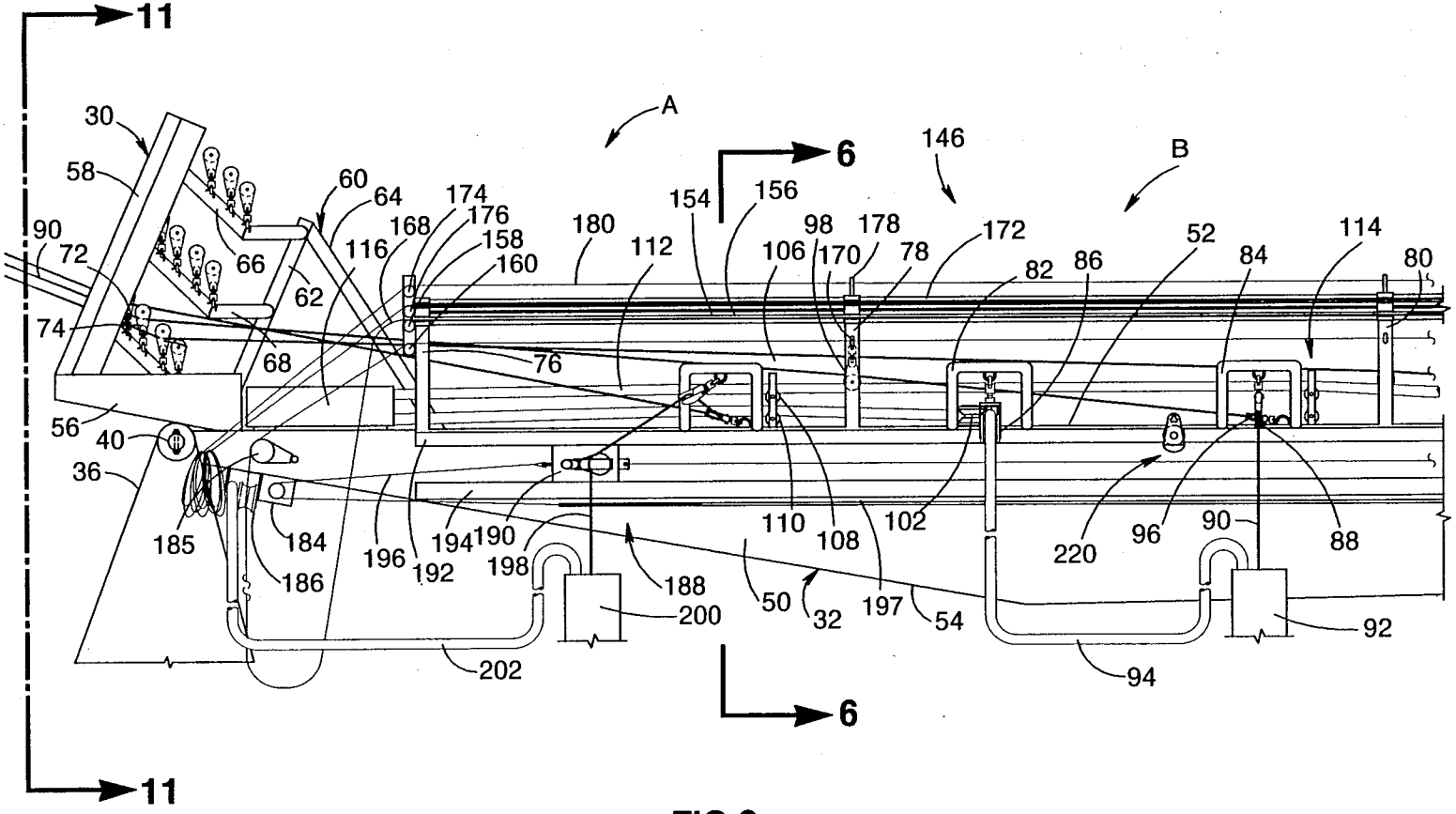
FIG. 3 is an enlarged view of the boom of FIG. 2 long line 3—3 with the boom being shown in a rigged condition.
Figure 9:
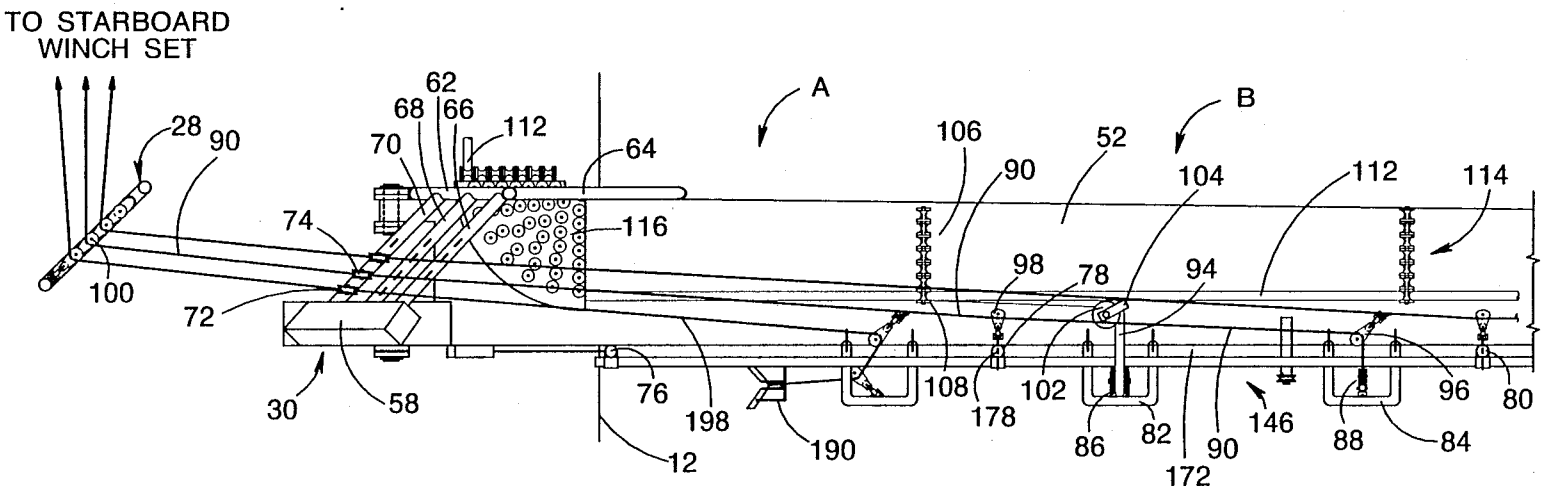
FIG. 9 is a plan view of the boom of FIG. 3.

Referring now to FIGS. 3 and 9, boom 32 comprises a first side portion 50 which extends from connection 40 to the most outboard end of boom 32. The first side portion 50 tapers from its widest point adjacent the pivotal connection of ram 42 to the boom to its narrowest point at the outboard tip of the boom 32. In the instant embodiment of the invention, the widest point is approximately 3 feet and the narrowest point is approximately 1 foot.

Figure 6:
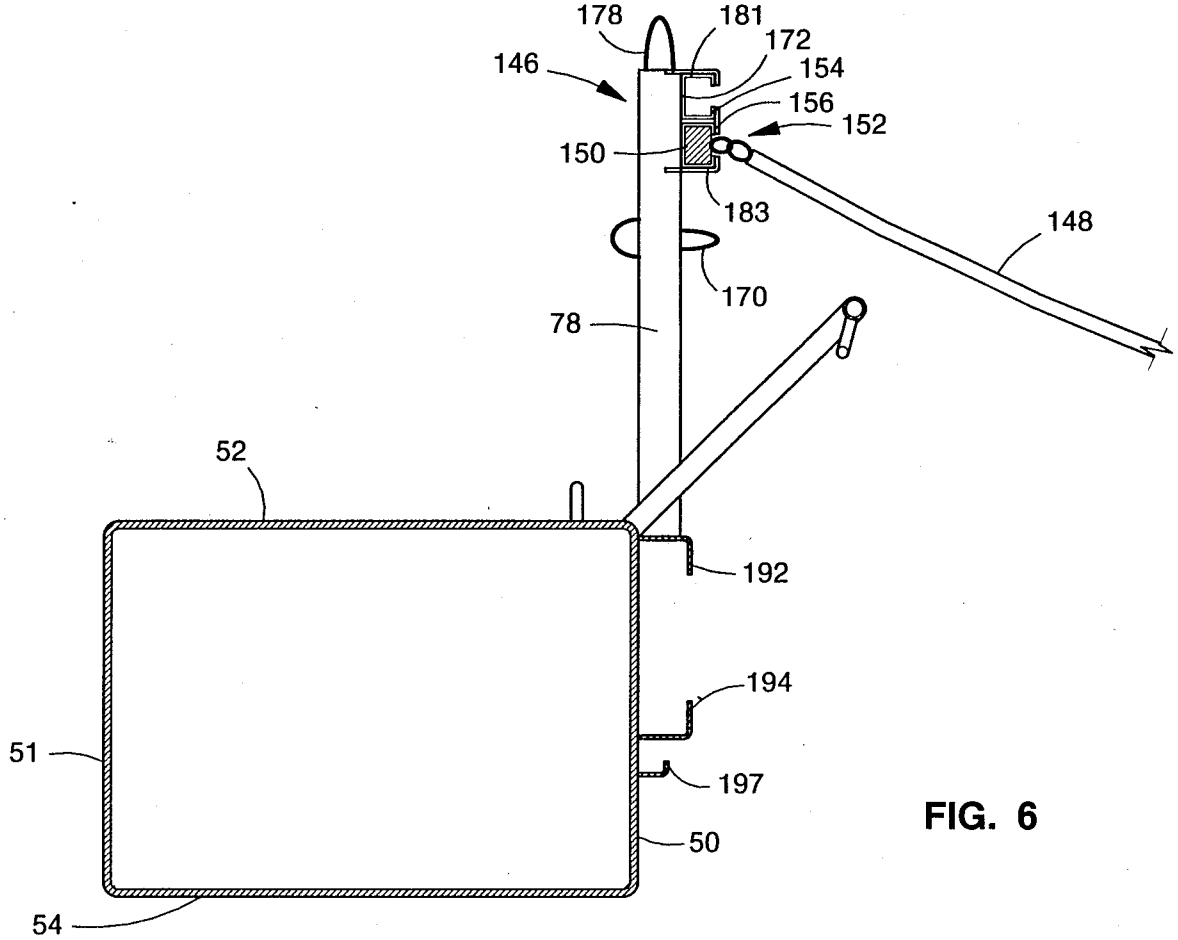
FIG. 6 is a slightly enlarged cross-sectional view taken along line 6—6 in FIG. 3.

Boom 32 also includes a top portion 52 and a bottom portion 54. The boom 32 further includes a second side portion 51, viewable in FIG. 12, opposite from first side portion 50. Each of the four portions making up boom 32 tapers from a wide point of approximately 3 feet adjacent the point at which ram 42 connects to the boom to a narrow point of approximately 1 foot at the outboard tip of the boom 32. Thus, the entire boom 32 tapers from a cross section of 3 feet by 3 feet to a cross section of 1 foot by 1 foot at the outboard tip of the boom. All four side portions are viewable in cross section in FIG. 6.

Figure 11:
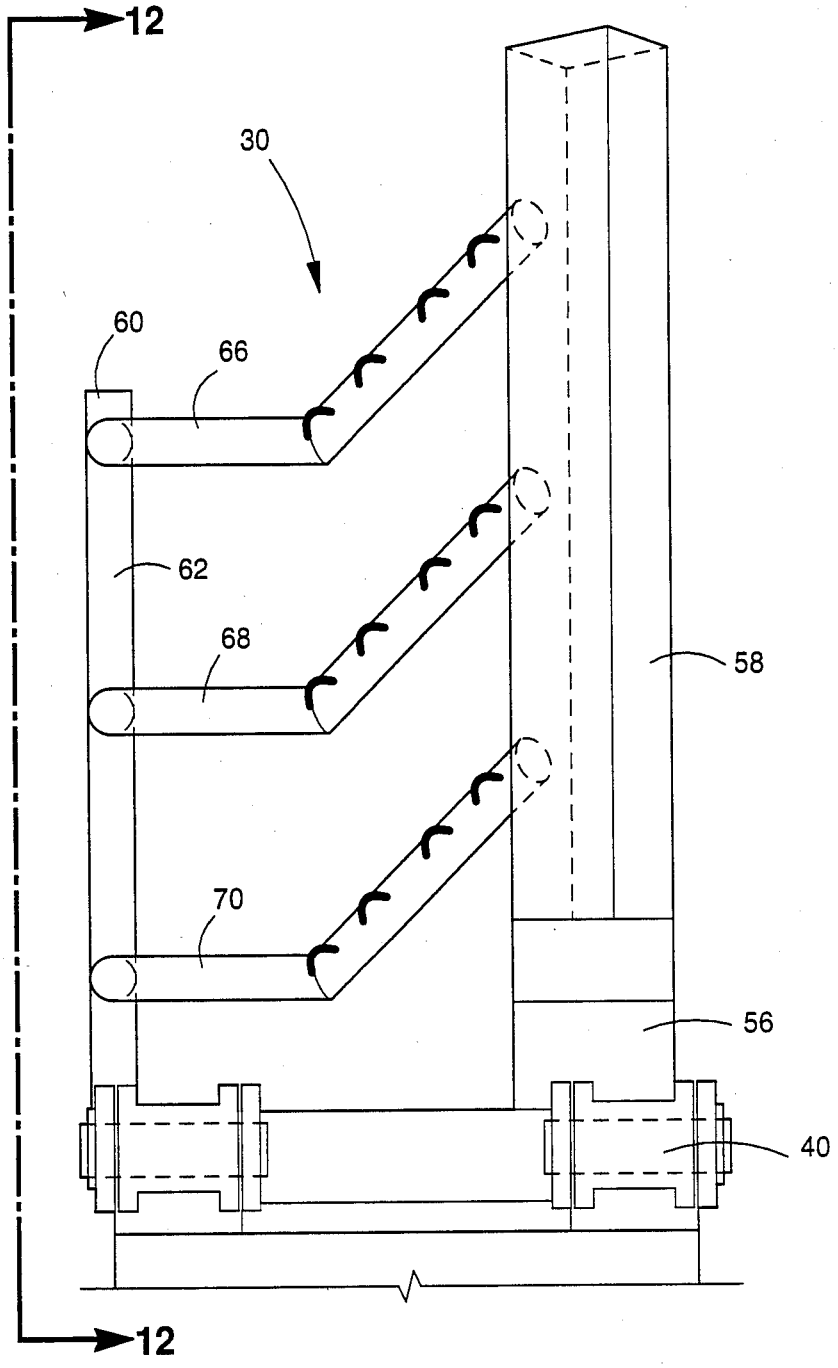
FIG. 11 is an enlarged view taken along line 11—11 in FIG. 3.
Figure 12:
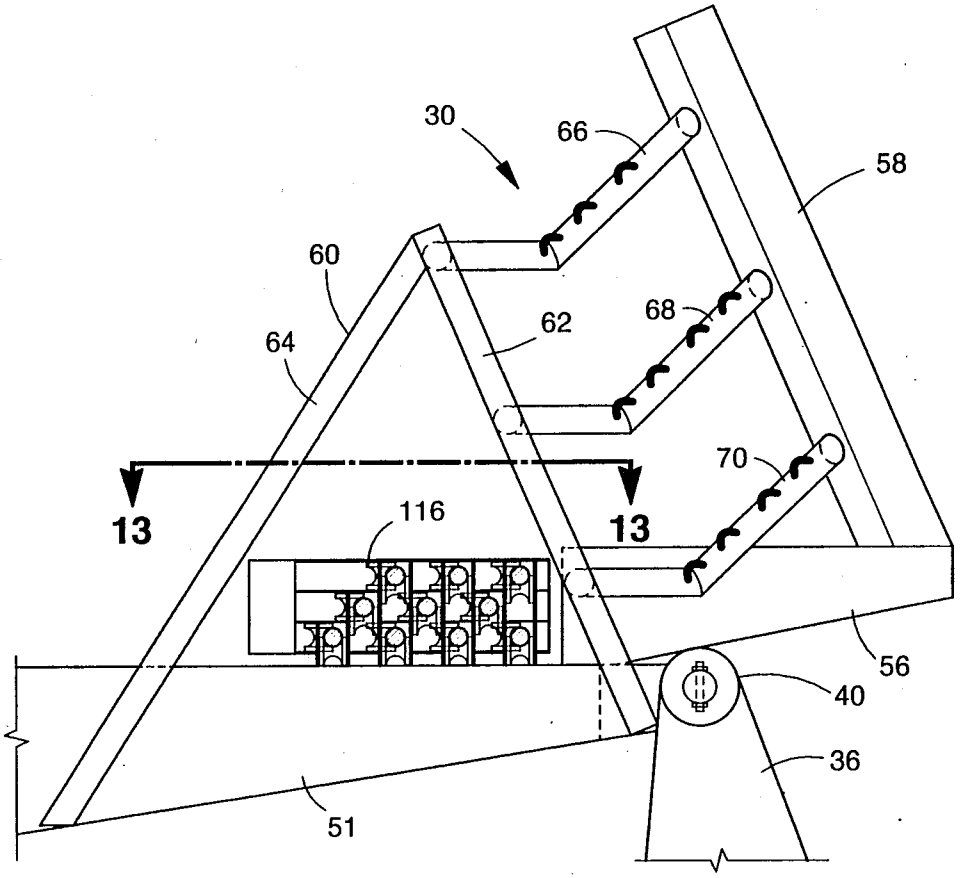
FIG. 12 is a view taken along line 12—12 in FIG. 11.

Referring now to FIGS. 11 and 12, guide frame 30 includes a first base segment 56, such being mounted on top portion 52 of boom 32. A support arm 58 extends upwardly from base segment 55 at an angle as shown. Base segment 56 and support arm 58 form one side of frame 30 while an A-frame 60 having a first leg 62 and a second leg 64 form the other side of frame 30. Three pulley supports 66, 68 and 70 extend between support arm 58 and leg 62. Each of the pulley supports comprises a substantially tubular element having a bend therein as shown. Commercially available pulleys, like pulleys 72 and 74 (as seen in FIGS. 18 and 19) are secured to the pulley supports by a connection which permits a substantial range of pulley movement.

Indicated generally at A and B in FIGS. 3 and 9 are airgun deployment stations with the opposing ends of station A being defined by upright posts 76 and 78 and opposing ends of airgun deplomment station B being defined by upright posts 78 and 80. As can be seen by examination of FIG. 2, there are a total of ten airgun deployment stations like station B positioned along boom 32 in addition to station A.

Included in station B are a pair of u-frames 82 and 84 which extend upwardly and outwardly from the boom as shown in FIGS. 3 and 9. A commercially available pulley 86 is mounted on u-frame 82 in a manner which permits a wide range of pulley movement relative to the u-frame. A similar pulley 88 is mounted on u-frame 84, also in a manner which permits a wide range of pulley movement relative to u-frame 84.

A support cable 90 comprises a wire rope and is journaled over pulley 88. A commercially available airgun 92 is attached to one end of cable 90 and is suspended beneath pulley 88 in the view of FIG. 3. Airgun 92 is also referred to herein as a geophysical exploration device. The airgun includes a chamber suitable for pressurizing with compressed air. When the airgun is submerged and compressed air therein is released, a seismic energy wave propagates through the water and into formations therebeneath. Reflected seismic energy is detected, in a manner which will be hereinafter described, and analyzed to determine the nature of the formations beneath the water.

A control line or commercially available firing line 94 is also connected to airgun 92. Firing line 44 includes therein a high pressure hose, a solenoid line for releasing compressed air from the gun, a depth transducer line, a gun phone line for measuring gun firing, and a stress line for supporting the weight of airgun 92 in the event that cable 90 should break. Cable 90 extends from pulley 88 to a second pulley 96, best viewed in FIG. 9. Pulley 96 is mounted on top portion 52 in a manner which permits movement of the pulley relative to portion 52. Cable 90 is journaled over another pulley 98, such being mounted on post 78 in the same manner as the previously described pulleys are mounted. Cable 90 extends between pulley 98 and pulley 74 on second frame 30. As viewed in FIG. 9, cable 90 extends between pulley 74 and a pulley 100 mounted on guide frame 28 (also viewable in FIGS. 18 and 19) and from there to a winch in starboard winch set 18.

Each deployment station on boom 32, like station B, includes a cable, like cable 90, which supports an airgun and which is connected to a winch in starboard winch set 18 in a manner similar to cable 90. Each cable is journaled over a pulley, like pulley 88, which is supported by a u-frame, like u-frame 84. Each cable is journaled over a pulley, like pulley 96, mounted on top portion 52 and from there extends to a pulley mounted on one of the posts, like pulley 98 on post 78. From the pulley on the post, each cable is journaled over an associated pulley in both guide frames 28 and 30 and extends between its pulley on guide frame 28 and the winch on which it is wound.

Firing line 94 extends from pulley 86 to a pulley 102, such being mounted on top portion 52 by a bracket 104 (viewable in FIG. 9). Firing line 94 passes through and is supported by a roller assembly 106. Roller assembly 106 includes an upper set of rollers visible in FIG. 9, one of which is roller 108, and a lower set of rollers, one of which is visible in FIG. 3, namely roller 110. Roller 108 supports a firing line 112 which extends along the boom to the outer end thereof across a second roller assembly 114 (in FIG. 3). Firing line 112 is connected to an airgun (not visible) in a employment station toward the tip of the boom from station B. Each of the rollers in each roller assembly supports a different firing line and rolls about the axis thereof to enable sliding the firing line along the length of the boom as will hereinafter be more fully explained.

Figures 4, 5:
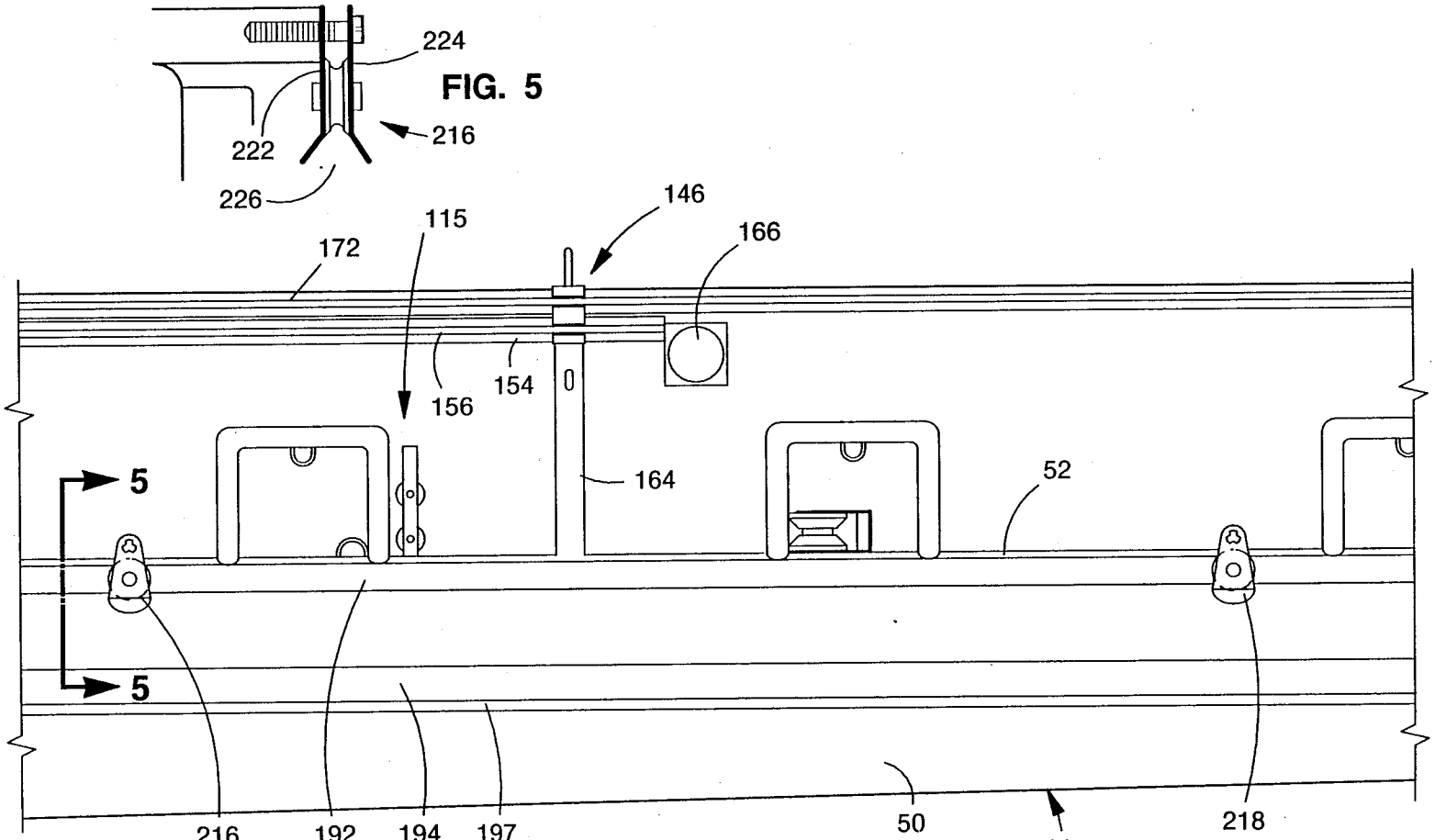
FIG. 4 is an enlarged view of the boom of FIG. 2 along line 4—4 with the boom in an unrigged condition.
FIG. 5 is a view taken along line 5—5 in FIG. 4.
Figure 10:
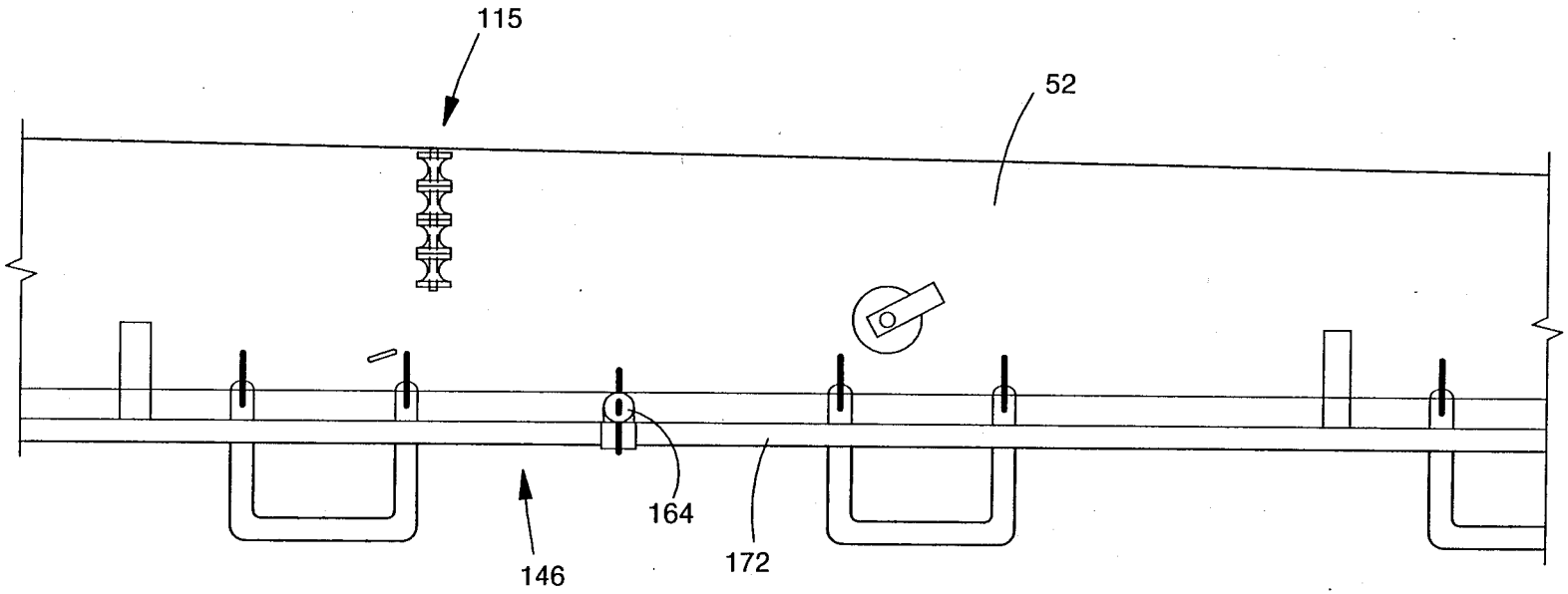
FIG. 10 is a plan view of the boom of FIG. 4.

Similar roller assemblies, one of which is roller assembly 115, viewable both in FIGS. 4 and 10, are positioned at intervals along the length of the boom to support a plurality of firing lines. A total of 11 airguns, each having an associated firing line, are deployed from boom 32. Ten of the airguns are deployed from the deployment stations like airgun 92 is deployed from station B in FIG. 3. The eleventh airgun is deployed from station A as shown in FIG. 3. Each airgun's associated firing line is received over a pulley suspended by a u-frame, like pulley 86 is suspended from u-frame 82 in station B. Each firing line is supported by roller assemblies, like roller assemblies 106, 114, and 115 positioned at intervals along the length of the boom. It can thus be seen that fewer firing lines are supported by the roller assemblies toward the tip of the boom while all of the firing lines from each of the ten deployment stations like deployment station B are supported on roller assembly 106. Thus, roller assembly 115 which, as can be seen in FIGS. 4 and 10, is approximately halfway along the length of the boom, and is arranged and constructed to accommodate fewer firing lines than roller assembly 106 which is the innermost roller assembly on the boom. The width of the boom makes it necessary to place the firing lines on upper rollers, like roller 108, and lower rollers, like roller 110, because the boom is not wide enough to accommodate all firing lines side-by-side.

Each of the firing lines supported by roller assembly 106 extend therefrom to a right-angle roller assembly 116 in FIGS. 3 and 9.

Figure 13:
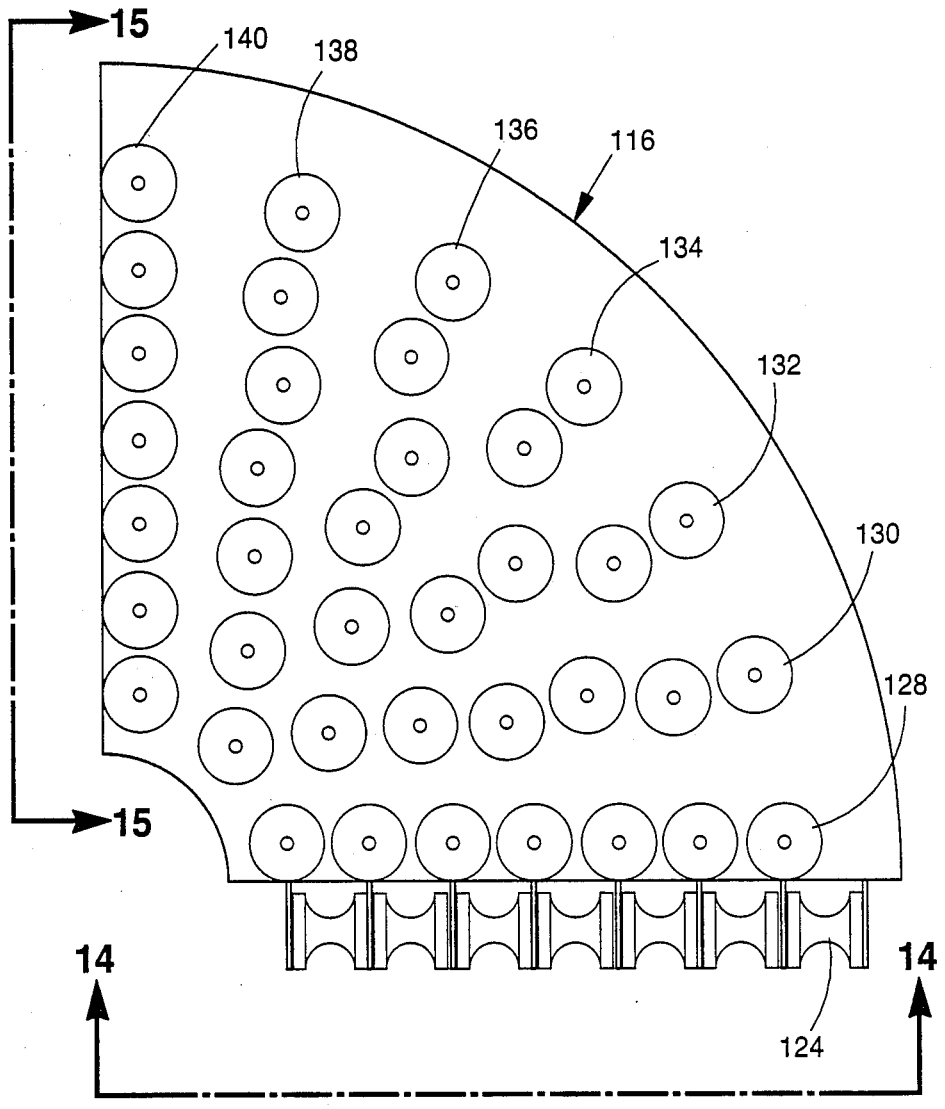
FIG. 13 is an enlarged view taken along line 13—13 in FIG. 12.
Figure 15:
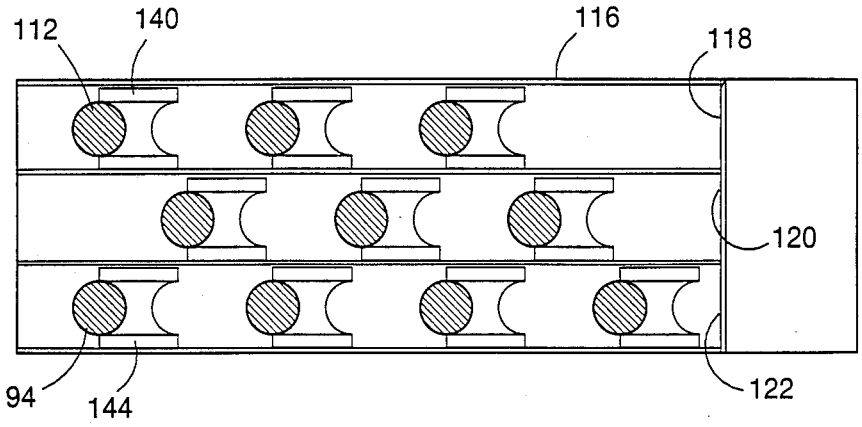
FIG. 15 is a view taken along line 15—15 in FIG. 13.
Figure 14:
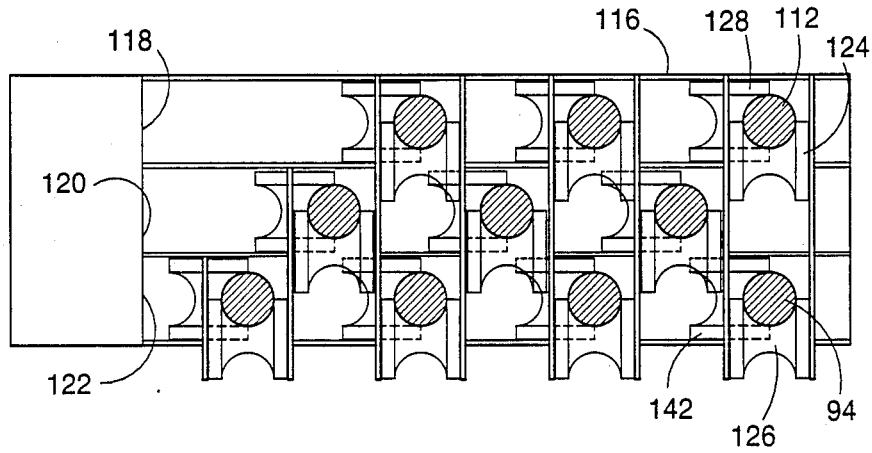
FIG. 14 is a view taken along line 14—14 in FIG. 13.

For a more detailed view of right-angle roller assembly 116, attention is directed to FIGS. 13–15. Roller assembly 116 includes three levels of rollers, a top level 118, a middle level 120, and a bottom level 122. Each of the firing lines which pass through and are supported by roller assembly 116 are shown in cross section in FIGS. 14 and 15, two of which are firing lines 94 and 112. Firing line 112 is supported by a roller 124 mounted on one side of assembly 116. Firing line 94 is supported in a similar fashion by a roller 126 as is each of the other firing lines as shown in FIG. 14. A plurality of rollers 128, 130, 132, 134, 136, 138, and 140 are mounted for rotation on vertical axles (not visible) in assembly 116 in the positions shown in FIG. 13 with roller 128 also being visible in FIG. 14 and roller 140 also being visible in FIG. 15. Firing line 94 is received against a series of vertically-mounted rollers on bottom level 122 which are directly beneath rollers 128–140 with one such roller 142 being visible in FIG. 14 and another such roller 144 being visible in FIG. 15.

Each of the other firing lines on each of the levels i assembly 116 is received against a plurality of vertically mounted rollers in a fashion similar to firing lines 94 and 112. There are a total of 66 rollers in assembly 116.

It can thus be seen that assembly 116 takes all of the firing lines through a 90° turn by forming a bend in each firing line having a radius which will not damage the firing line. The rolling action of the rollers enables the firing lines to be drawn in either direction through assembly 116.

Returning again to FIGS. 3 and 9, indicated generally at 146 is a shuttle assembly. The shuttle assembly 146 is used to deploy a commercially available mini-streamer 148 (in FIG. 6), such also being referred to herein as a cable having a geophysical exploration device attached thereto. The mini-streamer includes therein a plurality of hydrophones which, when submerged in the water, detect seismic energy such as that generated by airguns deployed from the boom. The hydrophones generate signals related to the detected seismic energy and apply the same to an electrical cable which extends between the mini-streamer and the ship in a manner which will be hereinafter explained. Mini-streamer 148 is connected to an aluminum block 150 (in FIG. 6) by a releasable connector indicated generally at 152. Block 150 is also referred to herein as shuttle means.

The block 550 is mounted on and received within a track 154, such being also referred to herein as an elongate tube. Track 154 includes an elongated slot 156 which extends along the length thereof. Track 154 has a first end mounted on post 76. The first end of track 154 includes a pair of pulleys 158 and 160 rotatingly mounted thereon. The other end of track 154 is mounted on a post 164 in FIG. 4, such being substantially identical to post 78 and 80 in FIGS. 3 and 6. A pulley 166 is mounted on the end of track 154 opposite pulleys 158 and 160. A line or rope 168 has one end attached to one side of block 150, which is approximately one foot long, and the other end attached to the other side of block 150. The rope is journaled over the tops of pulleys 158 and 160 and around pulley 166. Thus, a portion of the open is received within and supported along the length of track 154. It can thus be seen that pulling rope 168 adjacent pulley 158 toward the ship moves block 150 along track 154 toward the ship. Pulling rope 168 adjacent pulley 160 toward the ship moves the block along track 154 away from the ship. Eyes, like eye 170 on post 78, are provided on each post for supporting rope 168. In the instant embodiment of the invention, track 154 is 57 feet long.

A second track 172 which is substantially identical to track 154 is mounted on the posts, like posts 78 and 80, above track 154. Track 172 extends to the outer end of the boom and includes thereon a pulley, like pulley 166. The end of track 172 toward the ship includes thereon pair of pulleys 174 and 176. Each of the posts, like posts 78 and 80 include an eye, like eye 178 on post 78, to constrain a line or rope 180 which is connected to a block (not visible) received in track 172 in the same manner as rope 168 is rigged in track 154. A ministreamer (not shown) is connectable to the aluminum block in track 172 in the same manner that mini-streamer 148 connects to block 150. In the instant embodiment of the invention, track 172 is 105 feet long.

Neither of tracks 154 nor 172 is fixedly attached to the posts which support them. Rather, the tracks are received between brackets, like brackets 181 and 183 in FIG. 6 which are welded to each post. The tracks are slidable within the brackets thus permitting bending of the tracks as boom 32 flexes.

Rollers 185 and 186 mounted on boom 32 enable rope 168 or rope 180 to be connected to a commercially available cathead (not shown) mounted on the ship. The cathead pulls the rope in order to move the blocks either direction in track 154 or track 172.

An electrical cable (not visible) is connected to the end of each mini-streamer and is received in and supported by its associated track. The electrical cable conducts signals from the hydrophones in the mini-streamer to equipment on the ship which records and displays data related to the seismic energy detected by the hydrophones. Each miii-streamer includes vanes which are controlled by signals applied to the electrical cable which connects the mini-streamer to the equipment on the ship. The angle of the vanes is selectively varied responsive to the signals to control mini-streamer tow depth.

Indicated generally at 188 in FIG. 3 is an airgun shuttle. The airgun shuttle 188 is also referred to herein as means for moving a selected one of the airguns between the ship and a position in which the device is suspended beneath the boom. Shuttle 188 includes a block 190 which is constrained between a pair of rails 192 and 194 welded to side portion 50 of the boom. Block 190 is slidable along the boom between rails 192 and 194 from the leftmost end of rails 192 and 194 to the outer tip of the boom. A chain 196 has one end connected to one side of the block 190 and the other end connected to the other side of lock 190. The chain is journaled over a sprocket (not shown) at the outermost end of tracks 192 and 194. The lower portion of the chain is supported by a lip 197 which is welded to side portion 50 of the boom substantially along the length thereof beneath track 194. Hydraulic motor 184 includes a sprocket 198 with which chain 196 is engaged. It can thus be seen that clockwise rotation of sprocket 198 under motor power as viewed in FIG. 3 causes lock 190 to move toward the tip of the boom while counterclockwise rotation thereof causes the block to move toward the ship.

A support cable 198 from which an airgun 200 is suspended is engaged with shuttle 188 in a manner which will be more fully explained hereinafter.

A firing line 202 connected to airgun 200 extends directly from the airgun to the ship without being supported on the top of the boom as are the other firing lines. Airgun deployment station A is unique in this respect because of its close proximity to the ship. Each of the other ten airgun deployment stations, like station B, have the firing line associated therewith extending between the deployment station and the ship on the top of the boom.

Figure 7:
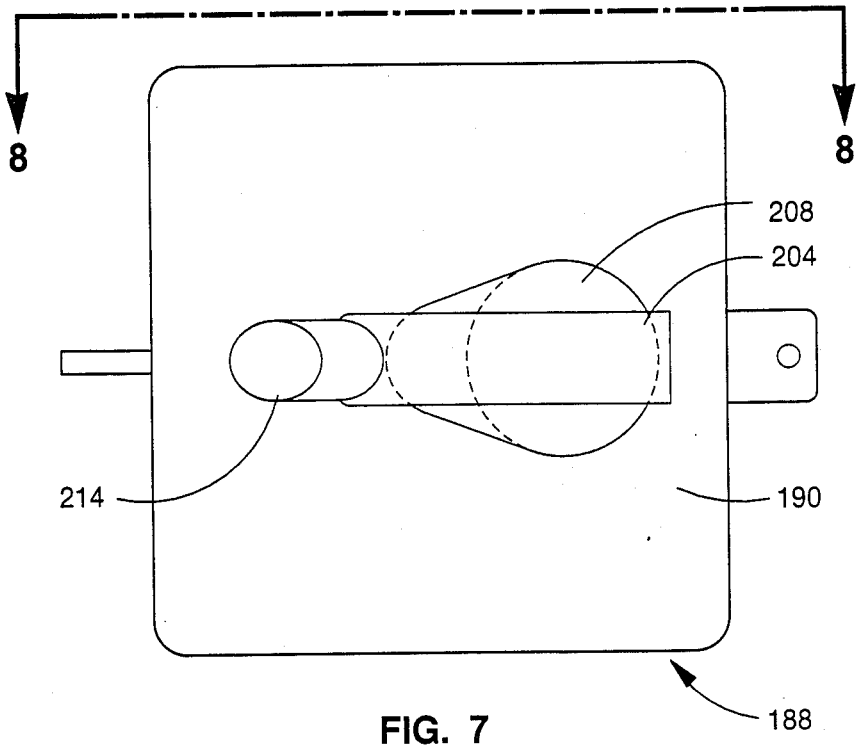
FIG. 7 is an enlarged view of the gun shuttle shown in FIG. 3.
Figure 8:
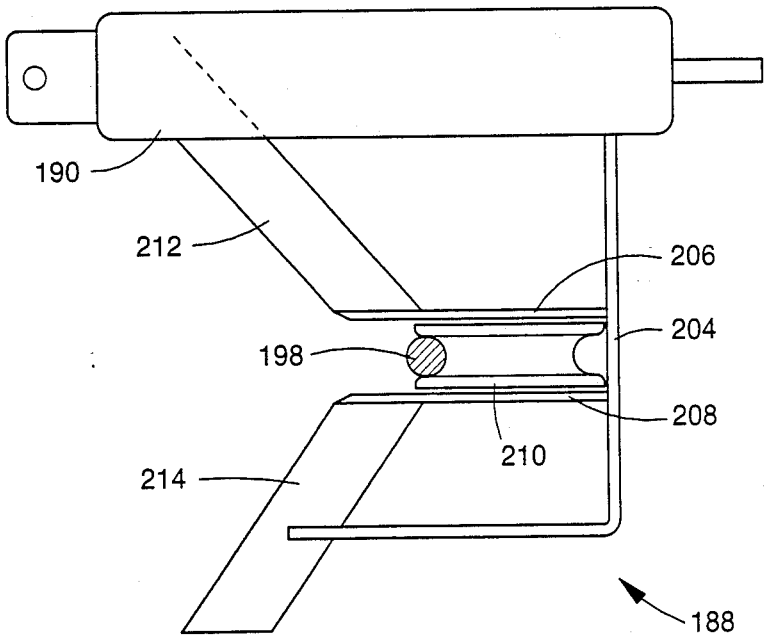
FIG. 8 is a view taken along line 8—8 in FIG. 7.

For a more detailed view of airgun shuttle 188, attention is directed to FIGS. 7 and 8. An L-shaped bracket 244 is mounted on block 190. A pair of opposed parallel plates 206 and 208 are welded to bracket 204 and have a roller 210 journaled for rotation therebetween. A first pipe 212 extends between plate 206 and block 190 and a second pipe 214 extends between plate 208 and bracket 204. Pipes 212 and 214 and roller 210 are referred to herein collectively as grabbing means.

Finishing now the description of the structure of the instant embodiment of the invention, attention is directed to FIGS. 4 and 5. A plurality of rollers, like rollers 216, 218 in FIG. 4 and roller 220 in FIG. 3 are mounted on the boom along the length thereof. Each roller is rotatingly mounted between a pair of plates, like roller 216 is mounted between plates 222, 224 which define a flared lower portion 226 which serves to guide cable into contact with the roller. As will later be explained in connection with the operation of the instant embodiment of the invention, these rollers prevent the support cable of an airgun from rising above the upper level of the boom when the airgun is being moved between its deployment station and the ship.

Although the majority of the detailed description herein relates to boom 32, it should be appreciated that boom 34 and its associated airguns, firing lines, support cables, etc., are substantially symmetrical with respect to boom 32 and its associated airguns, firing lines, etc.

Considering now the operation of the instant embodiment of the invention, attention is directed to FIG. 16. Initially, prior to deploying the airguns and mini-streamers for conducting a geophysical survey, ship 12 is in the configuration of FIG. 16. When so configured, the ship can move easily in and out of port and can travel to the survey area. When in the position of FIG. 16, each of the 11 airguns, like airguns 92 and 200 in FIG. 3, are suspended by their associated support cables like airgun 92 is suspended from cable 90, adjacent the boom. Each of the airguns are so suspended above the deck of ship 12. In addition, the firing lines which are deployed from the ten airgun deployment stations, one of which is station B, are connected to the airguns and extend via pulleys, like pulleys 86 and 102 to the top of the boom and from there through the roller assemblies, like roller assemblies 106, 114, and 115 to right-angle roller assembly 116. From roller assembly 116, each firing line is received in a bin on the ship.

When it is desired to move booms 32 and 34 to their extended and athwart ships positions as shown in FIG. 1, the pedestals upon which the booms are mounted, like pedestal 36 in FIG. 2, are turned until each boom is in the configuration of FIG. 1. Thus, guide frame 30 moves from the configuration shown in FIG. 18 to the configuration shown in FIG. 19. Since the pulleys on guide frame 30 are located substantially over pivot axis 44 of the pedestal 36, each of the airguns remains at substantially the same level. Because of the manner in which the pulleys are attached to guide frames 28 and 30, as the boom pivots to an extended condition, the pulleys move to permit reorientation of the support cables while preventing the cables from becoming entangled with one another.

When the booms are in the solid line configuration of FIG. 2, each of the rams like ram 42, is extended to raise the booms to the dashed line position of boom 32. The length and weight of the boom tends to permit relatively substantial fluctuations of the boom responsive to ship movement. Moving the booms to their raised positions prevents the tips of the booms from touching the surface of the water.

Typically, the mini-streamers, like ministreamer 148, are first deployed via shuttle assembly 146. First, a rope 180 is wound on a cathead (not shown). The cathead is energized to pull the rope to drive the block in track 172 to the leftmost end of the track. The mini-streamer is paid out from the deck until the same is deployed directly behind boo 32. The end of the mini-streamer is then attached to the block. Thereafter, the direction of block travel is reversed by winding the other side of the rope on the cathead thereby moving the block in track 172 toward the outermost end thereof. An electrical cable connected to the end of the mini-streamer attached to the block is received in track 172 and is pulled therealong by the block.

Thereafter, rope 180 is removed from the cathead and rope 168 is wound thereon. Block 150 (in FIG. 6) is moved under power of the cathead to the innermost end of track 154. When so moved, mini-streamer 148 and the electrical cable associated therewith are connected to block 150. The direction of block travel is reversed by winding the other side of the rope on the cathead and the block is moved to the outermost end of track 154 adjacent pulley 166 in FIG. 4. A third mini-streamer is typically deployed from behind the boom but is done so only four feet from the side of the boat and is therefore manually connected to and disconnected from the boom without the use of the shuttle.

Next, the winches in port and starboard winch sets 16 and 18 are activated to reel out cable. As the cables are reeled out, each of the airguns lowers into the water. Forward movement of the ship causes the airguns to trail behind the ship beneath the surface of the water. As the airguns deploy directly to the rear of their respective deployment stations, filing lines, like firing lines 94 and 112 are pulled through the roller assemblies on the boom and through right-angle roller assembly 116. As, e.g., firing line 112 is drawn through roller assembly 116, it bears against rollers 128–140 (in FIG. 13) which roll about their vertical axes as the firing line travels through assembly 116. In a similar fashion each of the rollers in the roller assemblies on the booms roll to facilitate movement of the cable thereover. Likewise, the pulleys through which the firing line is provided to its associated airgun, like pulleys 86 and 102 in deployment station B, rotate to enable firing like movement therethrough.

It should be appreciated that since each of the winches in winch sets 16 and 18 are independently controlled, the airguns can be deployed at different lengths behind the boom to create a selected areal array pattern. Each of the airgun support cables and its associated firing line are independently moveable regardless of the movement or lack thereof of the other cables and their associated firing lines.

Typically, at least two airguns and their associated firing lines are deployed directly from the stern of ship 12 in the usual manner but such is not shown in the drawings for the sake of clarity.

Typically, the mini-streamers are deployed prior to deploying the airguns; however, the instant embodiment of the invention is constructed and arranged to enable deployment of the airguns first if such is necessary or desirable.

When booms 32 and 34 are in the configuration of FIG. 1 with each of the airguns deployed underwater to a selected length behind the booms and the mini-streamers deployed on each boom as described above, seismic surveying operations may be undertaken.

If during the course of such operations one of the airguns fails or is in need of maintenance, airgun shuttle 188 is moved under power of hydraulic motor 184 along tracks 192 and 194 until block 190 is positioned on the boom outboard of the deployment station for the airgun of interest. The shuttle does not contact any of the support cables, but rather passes therebeneath since the cables are held away from the rear of the boom in the fashion similar to mini-streamer 148 (in FIG. 6) when the airguns are deployed. After the airgun shuttle is outboard of the airgun to be retrieved, the winch on ship 12 associated therewith is energized to reel cable in.

It will be appreciated that each of the other support cables remain fixed in their deployed positions during this process. The firing line is not retrieved but is allowed to trail in the water as the airgun cable is reeled in.

When the airgun of interest is suspended adjacent the boom, like airgun 92 in FIG. 3, hydraulic motor 184 is energized to move airgun shuttle 188 toward the ship. As the shuttle passes above the suspended airgun, the support cable from which the airgun is suspended is guided by pipes 212 and 214 (in FIG. 8) toward roller 210 until the cable assumes the position of cable 198 in FIG. 8. Further inward movement of airgun shuttle 188 pulls the support cable therewith. As the shuttle moves, the winch upon which the support cable is wound is activated to reel out cable thereby maintaining the airgun at substantially the same vertical position relative to the boom by maintaining constant tension on the support cable. As cable is so reeled out, roller 210 on the airgun shuttle 188 turns as does each of the other pulleys through which the cable in question is journaled. The support cable is held beneath the level of top portion 52 of the boom by rollers, like rollers 216 and 218 in FIG. 4 and roller 220 in FIG. 3.

When the airgun shuttle 188 reaches substantially its most inboard range of travel as shown in FIG. 3, the retrieved airgun is over the deck of ship 12. After airgun shuttle 188 travel is stopped, by stopping motor 184, the airgun is lowered to the deck of the ship by reeling out additional cable from the winch. The airgun may be repaired or serviced or a replacement airgun may be substituted on the end of the cable for the original airgun. In any event, an airgun is redeployed from the deck of the ship by reeling cable onto its associated winch thereby raising the airgun above the deck. Thereafter, motor 184 is activated to drive block 190 toward the outboard tip of the boom. As the block 190 is so driven, the support cable for the airgun is reeled onto its associated winch thereby maintaining the airgun at substantially the same vertical level relative to the boom. When block 190 passes the airgun deployment station from which the airgun was retrieved, motor 184 is stopped and the winch associated with the airgun is activated to pay cable out thereby deploying the airgun in the same manner as previously described.

The small size and low weight of the airgun shuttle 188 enable the same to retrieve airguns deployed from stations out to the tip of the boom. If the shuttle 188 was heavy, the boom would not support its weight. If the shuttle was larger, there would not be room for the same at the outboard tip of the boom.

If it should be necessary to retrieve one of the mini-streamers, for example the outer mini-streamer which is deployed on track 172, the two other mini-streamers deployed from boom 32 are towed at 30 feet while the outer streamer is towed toward the surface. Such depths are selected by applying signals to the electrical cables connecting the mini-streamers to the ship. The signals change the attitude of the vanes on the ministreamers thereby changing the mini-streamer tow depth. After the outer mini-streamer is surfaced and the two inner streamers are taken to a depth of 30 feet, rope 180 is engaged with the cathead as previously described and the block in track 172 is moved toward the ship The outer mini-streamer passes over the two other mini-streamers and may be replaced or repaired as necessary without the necessity of retrieving the other mini-streamers. In a similar fashion, the cable in the middle, which is deployed on track 154, may be towed on the surface while the innermost cable is towed at a lower depth to enable the middle mini-streamer to be retrieved.

When the survey is complete, all of the winches are activated to reel in cable until the airguns are suspended adjacent the boom, like airgun 92 in FIG. 3. As the airguns are moved to their suspended conditions, the firing lines associated with each airgun may be manually pulled through the roller assemblies on the boom and through roller assembly 116 and stored in their respective bins. When all of the airguns are suspended adjacent the boom, like airgun 92 in FIG. 3, the rams, like ram 42 (in FIG. 2), are contracted thereby moving boom 32 from the dashed line position to,-the solid line position. The rams associated with boom 34 are likewise contracted and thereafter pedestal 36 is rotated until the boom again assumes the configuration of FIG. 16.

It can be seen that the length of booms 32 and 34 enable airguns to be deployed in an extremely wide (approximately 240 feet) areal array. At the same time, each airgun is independently deployed and may be retrieved for repair or replacement and redeployed as described. The manner in which the support cables and firing lines are rigged on the booms permits operation of the winches to reel in or out cable regardless of boom position. Thus, when the booms are stowed as shown in FIG. 16, support cable may be reeled out to lower an airgun to the ship deck for service or repair. Locating the winches on the ship rather than on the booms considerably reduces the weight the booms must support and thereby permits the booms to be longer than those provided in the prior art. Since ship speed need not be maintained above a minimum level in order to urge paravanes outwardly to maintain a wide array, the instant invention permits lower speed wide-array surveying than was possible in the prior art.

It is to be appreciated that additions and modifications may be made to the instant embodiment of the invention without departing from the spirit of the invention which is defined in the following claims.

I claim:

1. An apparatus with a ship for conducting geophysical exploration in a marine environment, comprising:

(a) a boom mounted with the ship and extending therefrom;

(b) a winch mounted with the ship and separate from the boom;

(c) a cable having a first end wound onto the winch;

(d) a geophysical exploration device attached to the other end of the cable;

(e) pulley means mounted on the boom at a selected distance from the ship for rotatably suspending the cable and attached geophysical exploration device therefrom;

(f) rotating means disposed between the boom and the ship for rotating the boom between an extended position in which the boom extends athwartships and a stowed position adjacent the ship; and (g) guide means interposed between the winch and pulley means for aligning the cable with the winch and pulley means as the boom is rotated between the stowed and extending positions.

2. The apparatus of claim 1 wherein the guide means includes:

(a) a first guide frame mounted with the boom substantially along the rotation axis of the rotation means; and (b) a second guide frame mounted with the ship, wherein the cable is rigid through the first and second guide frames between the winch and the pulley means.

3. The apparatus of claim 1 further including:

shuttle means with the boom for positioning the geophysical exploration device at selected distances along the boom from the ship.

4. The apparatus of claim 3 wherein the shuttle means includes:

means for grabbing the cable at a pulling point between the winch and the geophysical exploration device; and pulling means for pulling the cable along a path substantially parallel to the boom axis.

5. The apparatus of claim 1 further including:

control means for providing communication between the geophysical exploration device and equipment mounted on the ship, wherein the control means includes a control line being rigged through a control line pulley mounted on the boom adjacent pulley means.

6. The apparatus of claim 1 further including:

pivot means disposed between the boom and the ship for pivoting the boom between a raised position and a lowered position.

7. An apparatus with a ship for conducting geophysical exploration in a marine environment, comprising:

at least one boom mounted on opposite sides of the ship and extending outwardly from each side of the ship;

a plurality of winches mounted on a ship and separate from the boom, wherein the winches are in sets of winches associated with each boom;

each winch having a first end of a cable wound thereon;

geophysical exploration devices attached to the other end of each cable;

pulley means mounted on the boom at selected distances from the ship for rotatably suspending each cable and attached exploration device therefrom; rotating means disposed between each boom and the ship for separately rotating the booms between an extended position in which each boom extends athwartships and a stowed position adjacent the ship; and guide means mounted with each boom substantially along the rotation axis thereof for aligning and separating cables o each winch associated with the boom as the boom rotates between the stowed position and the extended position.

8. The apparatus of claim 7 further including:

second guide means mounted on the ship adjacent the guide means mounted with each boom for aligning and separating the cables of each winch set.

9. The apparatus of claim 7 further including:

shuttle means with each boom for moving a selected one of the geophysical exploration devices between the ship and a selected position along the boom from which the geophysical device is suspended from the boom by the cable t which it is attached.

10. The apparatus of claim 9 wherein the shuttle means includes:

a hook extending therefrom which is sized to permit the hook to pass beneath a cable suspended from one of pulling means and having one or more geophysical exploration devices connected thereto deployed in the water astern of the boom and to engage the cable.

11. The apparatus of claim 10 wherein the shuttle means further includes:

cable means connected to the shuttle means for positioning the shuttle at selected positions along the boom to position and retrieve geophysical exploration devices at selected pulley means.

12. The apparatus of claim 9 further including second shuttle means mounted on the boom having a geophysical exploration device connected theretofore positioning the geophysical exploration device along the boom at selected distances from the ship.

13. A method for conducting geophysical exploration using a ship having a winch and a boom separately mounted thereon, comprising the steps of:

(a) rigging one end of a cable to the winch and rigging the other end of the cable through pulley means mounted with the boom and guide means interposed between the winch and the pulley means;

(b) attaching a geophysical exploration device to the other end of the cable;

(c) positioning the geophysical exploration device along the boom at a selected distance from the ship; and (d) horizontally rotating the boom from a stowed position adjacent the ship to an extended athwartships position; and (e) aligning and separating the cables from the winch to the pulley means with the guide means while horizontally rotating the boom to the extended athwartships position and maintaining such alignment and separation during the course of conducting geophysical exploration.

14. The method of claim 13 wherein movement of the boom to an extended position includes rotating the boom horizontally from the stowed position to the extended position.

15. The method of claim 14 wherein movement of the boom to the extended position includes:

pivoting the boom vertically about the end mounted with the ship.

16. The method of claim 13 further including:

operating the winch to position the geophysical exploration device in the water a selected distance from the bottom.

17. The method of claim 13 wherein the step of positioning the geophysical exploration device at selected distance along the boom comprises:

engaging the cable at a pulling point a selected distance from the attachment of the geophysical exploration device tot he cable with a shuttle means; and

18. The method of claim 17 further including maintaining constant tension on the cable between the winch and the pulling point.

19. A system for deploying and retrieving a wide array of geophysical exploration devices from a ship having a plurality of winches mounted thereon for deploying and retrieving individual geophysical devices attached thereto with a cable comprising:

(a) a boom mounted with the ship and separate from the winches;

(b) rotating means disposed between the boom and the ship for horizontally rotating the boom between an extended position in which the boom extends athwartships and a stowed position adjacent the ship;

(c) pulley means mounted on the boom at selected distances from the ship for rotatably suspending a geophysical exploration device therefrom; and (d) guide means interposed between the winch and pulley menns for aligning and separating the cables from the winches to each geophysical exploration device while rotating the boom to and from the extended athwartships position and for maintaining such alignment and separation during the course of conducting geophysical exploration.

20. The system of claim 19 further including:

shuttle means with the boom for individually retrieving and deploying selected geophysical exploration devices from selected pulley means.

21. The system of claim 20 further including:

means for maintaining a constant tension on the cable to which the geophysical device is attached while retrieving and deploying the selected geophysical device.

* * * * *

UNITED STATES PATENT AND TRADEMARK OFFICE

CERTIFICATE OF CORRECTION

PATENT NO. : 4,793,274

DATED : Dec. 27, 1988

INVENTOR(S) : William R. Regone

It is certified that error appears in the above—identified patent and that said Letters Patent is hereby corrected as shown below:

Column 4, line 35, "99" should read --19--.

Column 6, line 49, "44" should read --94--.

Column 8, line 9, "i" should read --in--; line 35, "550" should read --150--; line 50, "open" should read --rope--.

Column 9, line 65, "244" should read --204--.

Column 11, line 3, "boo" should read --boom--.

Column 13, line 5, after "ship" and before "The", insert --.--.

Column 14, line 57, "o" should read --of--.

Claim 9, Column 15, line 1, "t" should read --to--.

Claim 16, Column 16, line 8, "bottom" should read --boom--.

Claim 17, Column 16, line 14, "tot" should be --to the--.

Signed and Sealed this

Seventeenth Day of July, 1990

*Attest:*

*Attesting Officer*

HARRY F. MANBECK, JR.

*Commissioner of Patents and Trademarks*